US011676782B2

(12) United States Patent
Gauthier et al.

(10) Patent No.: US 11,676,782 B2
(45) Date of Patent: Jun. 13, 2023

(54) DOME-ACTUATOR STRUCTURE FOR USE IN A DOME SWITCH, AND A DOME SWITCH COMPRISING SUCH A STRUCTURE

(71) Applicant: C&K COMPONENTS S.A.S., Dole (FR)

(72) Inventors: Philippe Gauthier, Liesle (FR); Fabrice Valcher, Dole (FR)

(73) Assignee: C&K COMPONENTS S.A.S., Dole (FR)

( * ) Notice: Subject to any disclaimer, the term of this patent is extended or adjusted under 35 U.S.C. 154(b) by 0 days.

(21) Appl. No.: 17/065,874

(22) Filed: Oct. 8, 2020

(65) Prior Publication Data

US 2021/0110984 A1 Apr. 15, 2021

(30) Foreign Application Priority Data

Oct. 10, 2019 (EP) ..... 19202356

(51) Int. Cl.
*H01H 21/24* (2006.01)

(52) U.S. Cl.
CPC ..... *H01H 21/24* (2013.01); *H01H 2215/006* (2013.01); *H01H 2221/016* (2013.01)

(58) Field of Classification Search
CPC ..... H01H 21/24; H01H 13/04; H01H 13/06; H01H 2215/006; H01H 2215/004; H01H 5/30; H01H 13/26
USPC ..... 200/5 A, 335, 513, 406, 329, 516
See application file for complete search history.

(56) References Cited

U.S. PATENT DOCUMENTS 4,943,696 A * 7/1990 Staples ..... H01H 13/06 200/302.1
4,972,057 A * 11/1990 Miyata ..... H01H 13/04 200/293
7,652,216 B2 * 1/2010 Sharrah ..... H01H 13/48 200/1 B
2009/0314619 A1 * 12/2009 Weber ..... H01H 13/7065 200/341
2014/0027254 A1 * 1/2014 Kudrna ..... H01H 13/7013 200/5 A
2016/0042885 A1 * 2/2016 Le ..... H01H 13/705 200/50.01

FOREIGN PATENT DOCUMENTS

EP 1884971 A1 2/2008
JP 2002367479 A 12/2002
WO 2009091394 A1 7/2009

* cited by examiner

*Primary Examiner* — Edwin A. Leon
*Assistant Examiner* — Iman Malakooti
(74) *Attorney, Agent, or Firm* — KDW Firm PLLC

(57) ABSTRACT

A dome-actuator structure for use in a dome switch is disclosed. The dome-actuator structure comprises a lower substantially horizontal lower dome, an upper actuator portion attached to the lower dome and that is positioned vertically over the lower dome such that depressing of the actuator portion operates to depress the lower dome, and a lateral arm that couples the actuator portion to the lower dome. The lateral arm and the lower dome are formed from a common piece of material. The actuator portion comprises an actuation block, made of plastic or synthetic material or made of natural or synthetic elastomer, fixed to the lateral arm.

16 Claims, 4 Drawing Sheets

DOME-ACTUATOR STRUCTURE FOR USE IN A DOME SWITCH, AND A DOME SWITCH COMPRISING SUCH A STRUCTURE

RELATED APPLICATIONS AND CLAIM OF PRIORITY

This patent document claims priority under 35 U.S.C. § 119(1) to European Patent Application Number 19202356.2 filed Oct. 10, 2019.

BACKGROUND

The present disclosure relates to a dome switch suitable for use in electrical or electronic devices.

Dome switches are well-known and often used in consumer electronic products to implement buttons. For example, various electronic devices typically include a push button that a user can press to invoke various operations with respect to such devices. Such buttons can, for example, be used for function buttons.

A dome switch includes a conductive switching or tripping element in the general shape of a dome made from metal or plastic that can be deformed temporarily by a user press to provoke a switching action, i.e. for establishing a switching way that was previously "OFF".

When the user press on the push button is removed, the dome returns to its original shape and the switching way is back to its "OFF" state.

Advantageously, dome switches may provide the user with a tactile feedback.

Conventional assembly of buttons implemented by dome switches is as follows.

For example, a dome must be placed on a substrate and corresponding structures often provide a push button or actuator structure that can be pressed downward to engage the dome during a button or key press.

Such an arrangement is illustrated in FIG. 19 of European Patent Application Publication No. EP1884971A1, published Feb. 6, 2008.

The formation of the button is a separate manufacturing step that is tedious and time-consuming. In addition, the placement of the button relative to the domes needs to be as accurate as desired and requests the provision of an additional presser component interposed between the lateral push button and the dome arrangement.

The actuation button and the dome are then integrated in a housing structure having electrical connection tabs or pins and the switch component can then be integrated in an apparatus for example by soldering the connection tabs or pins of the switch housing on an upper face of a PCB (Printed Circuit Board).

With a view to simplifying the structure and the assembly of a dome switch, it has been proposed in U.S. Pat. No. 7,687,734 a general concept of a dome switch with integral actuator.

However, in connection with such a concept of an integrated design of the dome and actuator, there is a need for solutions with a view to integrating this design in an electronic apparatus in which there is a need for possibly actuating the switch along various directions, including possible pre travels and/or a need for industrially fixing the dome-actuator structure on a substrate while keeping the switching characteristics of the dome including the tactile feedback.

SUMMARY

This document describes a dome-actuator structure—for use in a dome switch—having a one-piece construction, comprising a dome and an actuator element attached to the dome and positioned over the dome such that depressing of the actuator operates to depress the dome, and wherein said dome and said actuator are integrally formed from a metal sheet.

This one piece structure may be fixed (by gluing or soldering) on a face of a substrate having electrical contacts such as a PCB permits to obtain a switch structure without any housing structure.

This document describes a dome-actuator structure for use in a dome switch. The dome-actuator structure comprises: a substantially horizontal lower dome; an upper actuator portion attached to the dome and that is positioned vertically over the dome such that depressing of the actuator operates to depress the dome; and a lateral arm that couples the actuator portion to the dome. The lateral arm and the dome may be formed from a common piece of material. The upper actuator portion may comprise an actuation block, made of plastic or synthetic material or of natural or synthetic elastomer, fixed to the lateral arm.

This document also describes a dome-actuator structure for use in a dome switch. The said dome-actuator structure comprises: a lower substantially horizontal dome; an upper actuator portion attached to the dome and that is positioned vertically over the dome such that depressing of said actuator operates to depress said dome; and a lateral arm that couples the actuator portion to the dome. The lateral arm and the dome may be formed from a common piece of material. The lateral arm may be connected to a peripheral edge of the dome by means of a radial connecting tab allowing the dome-actuator structure to be fixed on a face of a substrate such as a PCB, by soldering or gluing.

The novel features of the invention are set forth with particularity in the appended claims. The invention will be best understood from the following description when read in conjunction with the accompanying drawings.

DETAILED DESCRIPTION

Figure 1:
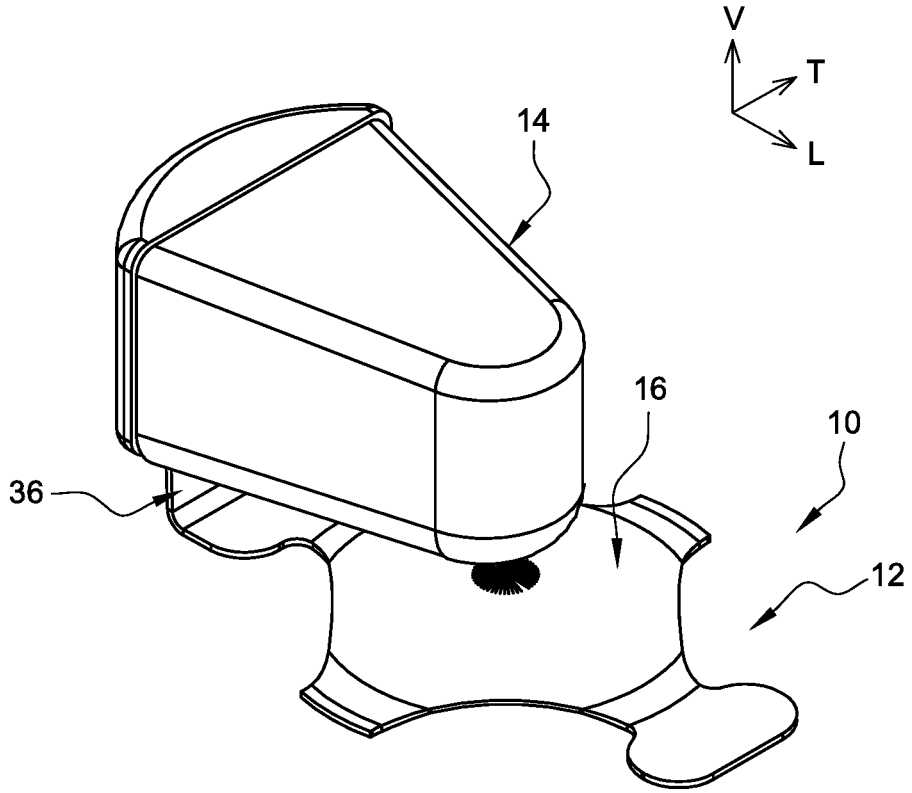
FIG. 1 is a top perspective view of a dome-actuator structure.
Figure 2:
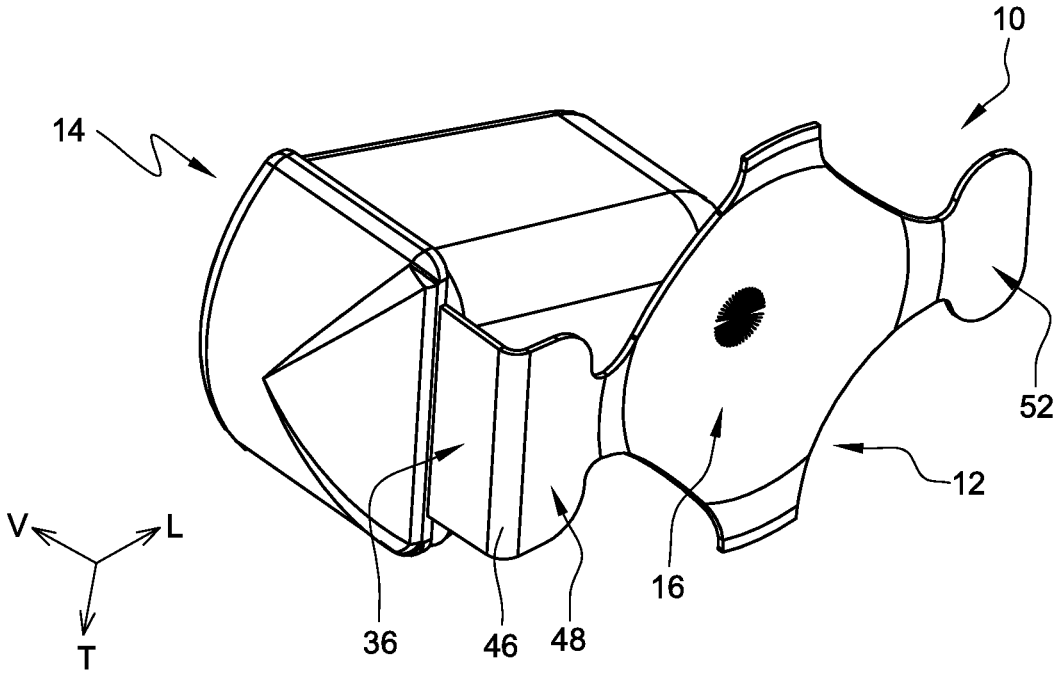
FIG. 2 is a bottom perspective view of the dome-actuator structure of FIG. 1.
Figure 3:
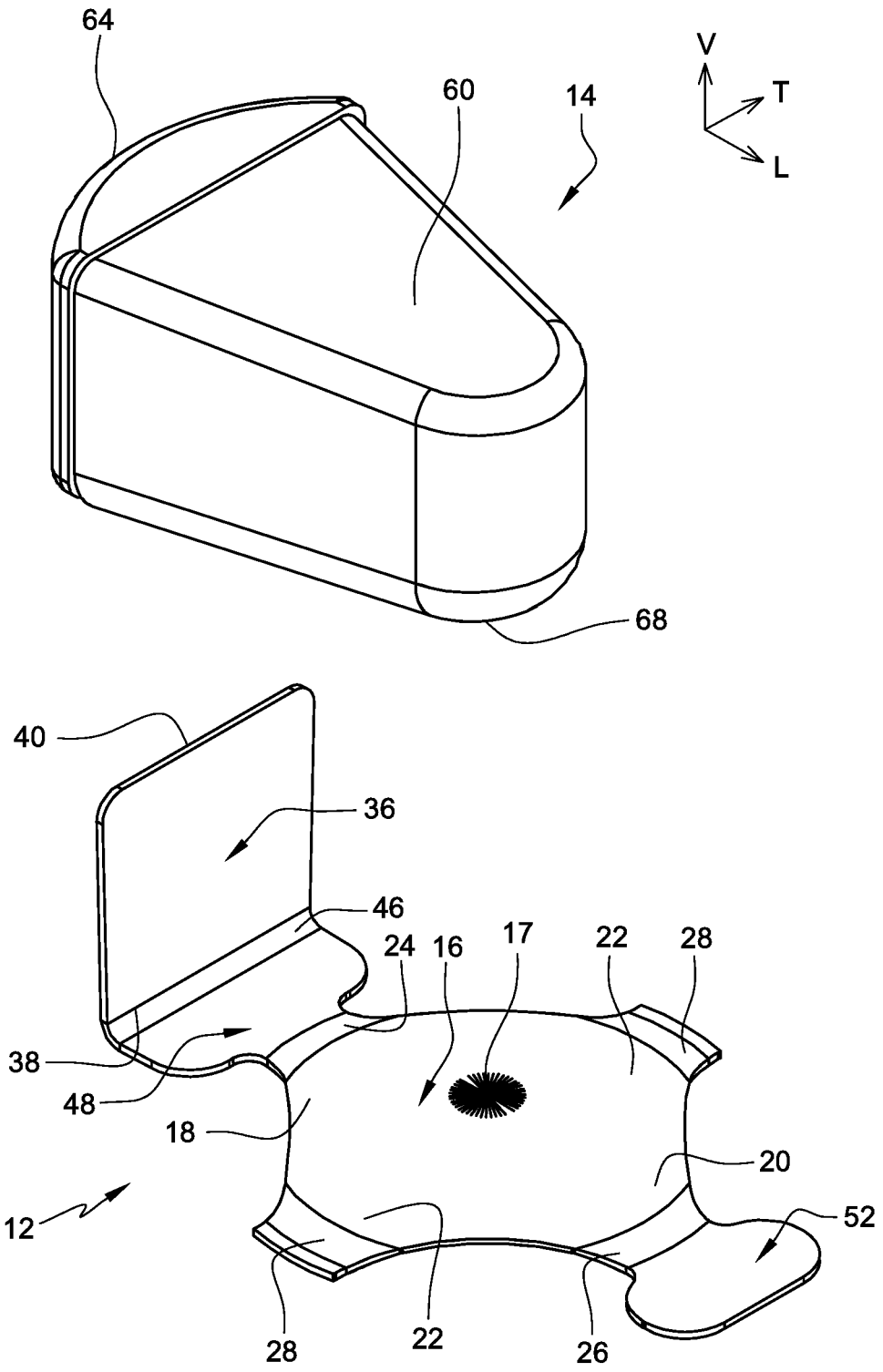
FIG. 3 is an exploded view of the dome and of the dome-actuator structure of FIG. 1.

For the description of the invention and the understanding of the claims, the vertical, longitudinal and transverse orientations according to reference mark V, L, T indicated in the figures (whose longitudinal axis L and transverse axis T extend in a horizontal plane) shall be adopted as non-limiting and without reference to earth gravity.

In the following description, identical, similar or analogous elements or components will be referred to by the same numeral references.

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to."

The dome-actuator structure 10 illustrated in FIGS. 1-7 includes a lower dome 12 and an upper actuator block 14 attached to the dome 12.

The dome-actuator structure 10 is thus a one piece component that is fixed on the upper face 102 of a substrate 100 to provide a dome switch assembly 200.

Figure 6:
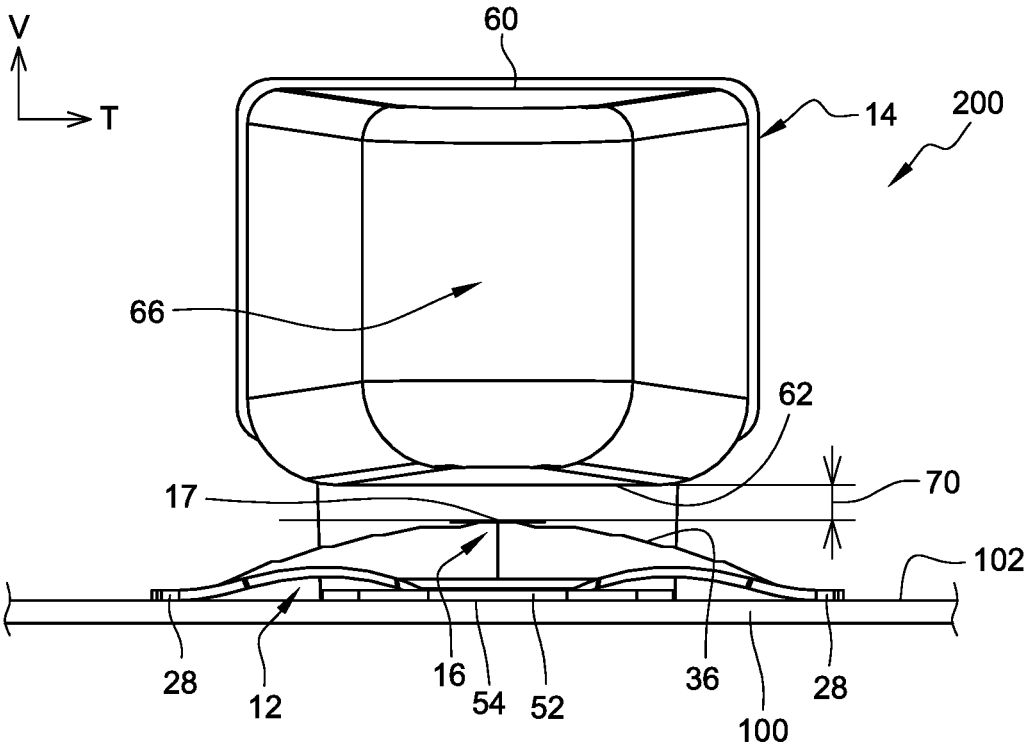
FIG. 6 is an end view of the dome-actuator structure of FIG. 1.
Figure 7:
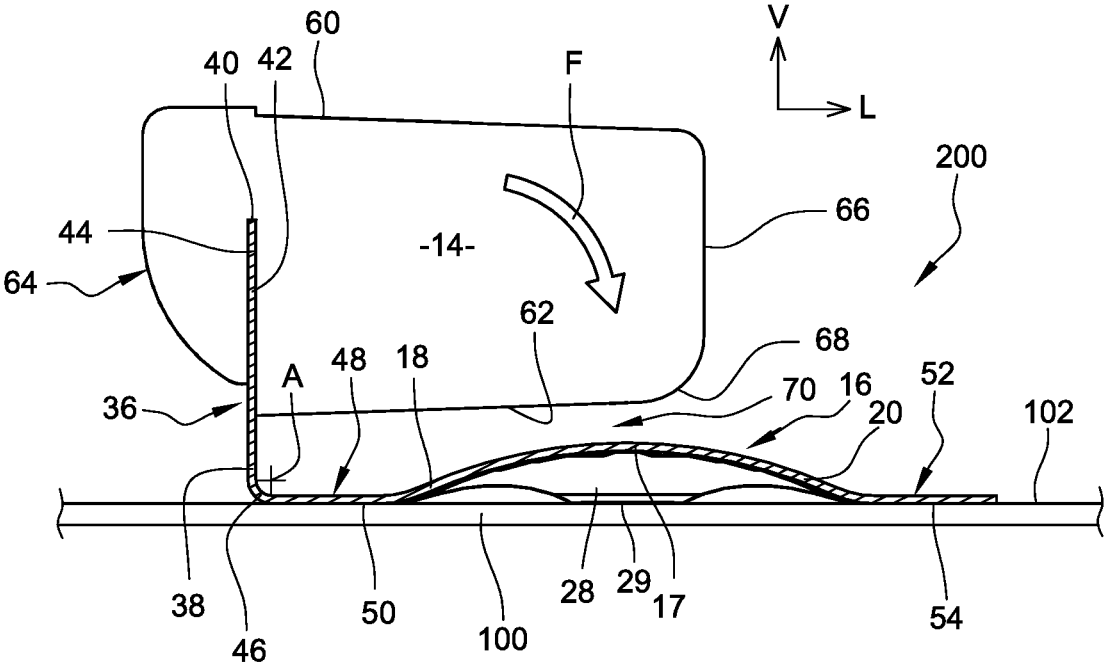
FIG. 7 is a cross-sectional view of the dome-actuator structure of FIG. 1 along line 7-7 of FIG. 5.

FIG. 6 and FIG. 7 illustrate a portion of a printed circuit board 100 on which the dome-actuator structure 10 is mounted. For example, the lower dome 12 of the dome-actuator structure 10 is soldered on the upper face 102 of the printed circuit board 100.

The lower dome 12 globally extends in a horizontal plane.

The lower dome 12 includes a main central dome shaped portion 16 having its convexity oriented upwardly and a middle upper summit portion 17.

The lower dome 12 also includes four peripheral branches, or arms, that extend radially outward from the central portion 16.

In a non-limiting manner, the lower dome 12 includes four peripheral branches that are distributed angularly at ninety degrees.

The four peripheral branches includes two diametrically opposed longitudinally extending peripheral branches 18 and 20 and two diametrically opposed transversely extending peripheral branches 22.

Each peripheral branch 18, 20 and 22 comprises a peripheral contacting distal portion 24, 26 and 28 respectively having each a peripheral edge 30, 32 and 34 respectively.

The peripheral distal portions 24, 26 and 28 with their peripheral edges 30, 32 and 34 respectively form the periphery of the lower dome 12.

For supporting the upper actuation block 14 and coupling it to the lower dome 12, the dome-actuator structure 10 includes a lateral arm 36.

The lateral arm 36 and the lower dome 12 are formed of a common piece of material, and are for example integrally formed of a cut and plied metal conductive sheet.

The lateral arm 36 is rectilinear and, in a non-limiting manner, extends vertically.

The lateral arm 36 extends vertically from a lower edge 38 towards an upper free edge 40.

About two thirds of the lateral arm 36 constitute an upper portion 42 of the lateral arm 36.

According to the illustrated embodiment of the invention, the actuation block 14 is molded over the upper portion 42 of the lateral arm 36 that ensures the fixing and the positioning of the actuation block 12 with respect to the lower dome 12 of the dome-actuator structure 10.

Thus, as it can be seen at FIG. 7, the upper portion 42 of the lateral arm 36 appears as received in an internal slot 44 of the actuation block 14.

The over molding technique for attaching the actuation block 14 on the upper portion 42 of the lateral arm 36 is particularly suitable for the mass production of a very small size dome-actuator structure 10, in particular by carrying out the molding operation of the upper portion 42 before the folding operations of the cut metal sheet.

According to a non-illustrated variant, the actuation block 14 can be molded separately with a receiving slot 44 therein and the upper portion 42 of the lateral arm 36 can be press fit therein.

The lower horizontal edge 38 of the lateral arm 36 is connected to the peripheral edge 30 of the peripheral branch 18 of the lower dome 12 by a bent elbow 46 and a horizontal connecting horizontal tab 48.

The connecting tab 48 extends longitudinally between the connecting elbow 46 and the peripheral edge 30.

The design of the connection between the lateral arm 36 and the lower dome 12 allows a pivoting, in both directions, of the lateral arm 36 with respect to the lower dome 12 by elastic deformation around a low transversal and substantially horizontal pivoting axis A, mainly by elastic deformation of the bent elbow 46.

In the drawings, the lateral arm 36 is illustrated in the non-deformed state of the dome-actuator structure 10 in which the lateral arm 36 extends vertically.

The horizontal connecting tab 48 extends radially in the extension of the peripheral branch 18 between the peripheral edge 30 thereof and the lower end of the lateral arm 36.

The radial connecting tab 48 has a flat horizontal underside 50 extending over the upper face 102 of the substrate 100.

This underside 50 provides has an important area, which provides for stability.

It is possible to use the underside surface 50 for fixing the dome-actuator structure 10, for example by soldering or gluing the dome-actuator structure 10 on the upper face 102 of the substrate 100.

The distal portions 28 of the two transversal peripheral branches 22 also terminate with a globally horizontal orientation and each have a flat horizontal underside 29 which might be used for fixing the dome-actuator structure 10 on the upper face 102 of the substrate 100.

Also for providing stability of the dome-actuator structure 10 on the upper face 102 of the substrate 100, the lower dome 12 may include an other radial connecting tab 52 having a flat horizontal underside 54.

This underside 54 has an important area, which provides for stability.

It is possible to use the underside surface 54 for fixing the dome-actuator structure 10, for example by soldering or gluing the dome-actuator structure 10 on the upper face 102 of the substrate 100.

The horizontal other connecting tab 52 extends radially in the extension of the peripheral branch 20, from the distal portion 26.

The two connecting tabs 48 and 52 are thus diametrically opposed and the four undersides 48, 29 and 54 are coplanar.

The upper actuation block 14 is delimited at least by an upper substantially horizontal face 60, a lower substantially horizontal face 62 and a rear end transversal face 64 that is globally convex.

The upper actuation block 14 extends longitudinally and globally horizontally from its rear end face 64 toward its arcuate shaped front end 66, over the lower dome 12.

The rear end of the block 14 is arranged close to the lateral arm 36 and extends cantilevered over the central portion 16 of the lower dome 12.

As it can be seen for example at FIG. 7, the lower part of the front end, or front nose, of the actuation block 14 is in the form of a rounded convex actuation portion 68 centered around a horizontal and transversal axis.

This actuation portion 68 is positioned vertically substantially above the central portion 16 of the lower dome 12 and is substantially aligned with the summit 17 such that depressing of the actuation block 14 operates to depress the lower dome 12.

Such a depression provokes the change of state of the lower dome to establish contact between non illustrated electrical contact traces on the upper face 102 of the substrate 100.

This change of state may advantageously provide a tactile sensation.

The design of the actuation block permits to exert an actuation effort thereon either globally vertically or globally laterally for provoking its pivoting movement around the axis A, clockwise when considering FIG. 7, indicated by arrow F.

A globally vertical actuation effort can be exerted on the upper face 60 and a lateral horizontal effort can be exerted on the rear end face 64.

Figure 4:
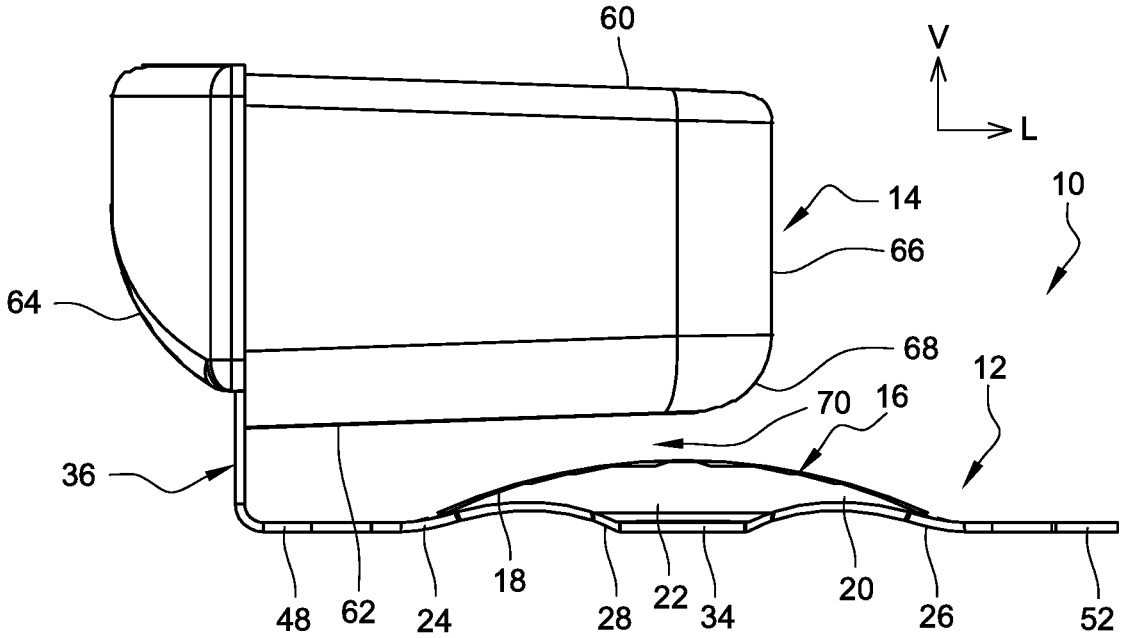
FIG. 4 is a lateral view of the dome-actuator structure of FIG. 1.
Figure 5:
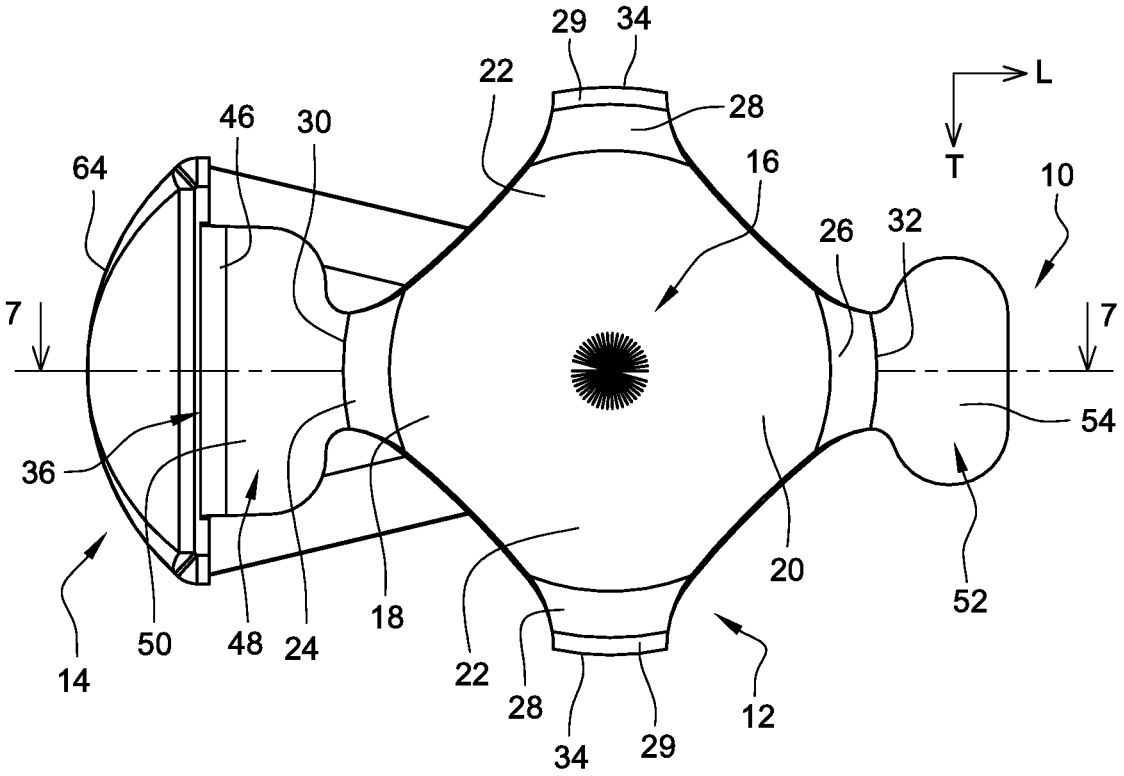
FIG. 5 is a bottom view of the dome-actuator structure of FIG. 1.

In the rest position and as it can be seen at FIG. 4, FIG. 6 and FIG. 7, a vertical space or "air gap" 70 is present between the lower face 62 and the summit 17 of the lower dome 12.

This provides with a pre travel capacity before the contact between the actuation portion 68 and the central portion 17 of the lower dome 16.

The invention claimed is:

1. A dome-actuator structure for use in a dome switch, the dome-actuator structure comprising:

a substantially horizontal lower dome;

an upper actuator portion attached to the lower dome and that is positioned vertically over the lower dome such that depressing of the actuator portion operates to depress the lower dome; and a lateral arm that couples the upper actuator portion to the lower dome, the lateral arm and the lower dome being formed from a common piece of material, wherein the upper actuator portion comprises an actuation block, made of plastic or synthetic material or made of natural or synthetic elastomer, molded over the lateral arm.

2. The dome-actuator structure according to claim 1, wherein the actuation block comprises one or more of the following:

a first upper actuation face for acting thereon along a substantially vertical downwards direction, or a second lateral actuation face for acting thereon along a substantially horizontal direction.

3. The dome-actuator structure according to claim 1, wherein:

the lateral arm is substantially rectilinear; and the actuation block is arranged at a vertical upper portion of the lateral arm, and extends horizontally over the lower dome.

4. The dome-actuator structure according to claim 3, wherein the lateral arm extends vertically.

5. The dome-actuator structure according to claim 1, wherein the lateral arm is connected to a peripheral edge of the lower dome by a connection allowing a pivoting of the lateral arm and of the actuation block around a lower and substantially horizontal pivoting axis.

6. The dome-actuator structure according to claim 5, wherein the lateral arm is connected to a peripheral edge of the lower dome by means of one radial connecting tab.

7. The dome-actuator structure according to claim 6, wherein the one radial connecting tab extends between a peripheral edge of the lower dome and a lower end of the lateral arm.

8. The dome-actuator structure according to claim 6, comprising another radial connecting tab.

9. The dome-actuator structure according to claim 8, wherein the one and the other radial connecting tabs are diametrically opposed.

10. The dome-actuator structure according to claim 6, wherein each radial connecting tab has a flat horizontal underside for extending over a facing portion of an upper face of a substrate.

11. The dome-actuator structure according to claim 10, wherein the undersides of the one and other radial connecting tabs are coplanar.

12. The dome-actuator structure according to claim 8, wherein:

the lower dome comprises a central dome-shaped portion having a periphery, and at least two peripheral branches radially and downwardly extending from the periphery of the central dome-shaped portion; and each radial connecting tab extends from the radial peripheral edge of an associated peripheral branch.

13. The dome-actuator structure according to claim 12, wherein the lower dome comprises four peripheral branches extending, radially and downwardly, from the periphery of the central dome-shaped portion and that are distributed angularly at ninety degrees.

14. A dome switch assembly comprising the dome-actuator structure according to claim 1 and a substrate having an upper face, wherein the lower dome is fixed on the upper face of the substrate by gluing or soldering.

15. The dome-actuator structure according to claim 1, wherein the lateral arm is formed of a metal.

16. The dome-actuator structure according to claim 1, wherein:

the actuation block comprises a receiving slot; and the lateral arm is press fit within the receiving slot.

* * * * *